US010704490B2

(12) United States Patent
Kylström et al.

(10) Patent No.: US 10,704,490 B2
(45) Date of Patent: Jul. 7, 2020

(54) METHOD AND SYSTEM FOR DIAGNOSING UNINTENDED FUELLING FROM FUEL INJECTORS OF AN ENGINE

(71) Applicant: SCANIA CV AB, Södertälje (SE)

(72) Inventors: Kim Kylström, Tullinge (SE); Roger Hälleberg, Nacka (SE); Ola Stenlåås, Södertälje (SE)

(73) Assignee: Scania CV AB, Södertälje (SE)

( * ) Notice: Subject to any disclaimer, the term of this patent is extended or adjusted under 35 U.S.C. 154(b) by 2 days.

(21) Appl. No.: 16/315,518

(22) PCT Filed: Jun. 19, 2017

(86) PCT No.: PCT/SE2017/050659
§ 371 (c)(1),
(2) Date: Jan. 4, 2019

(87) PCT Pub. No.: WO2018/013032
PCT Pub. Date: Jan. 18, 2018

(65) Prior Publication Data

US 2019/0316542 A1 Oct. 17, 2019

(30) Foreign Application Priority Data

Jul. 12, 2016 (SE) ..... 1651041

(51) Int. Cl.
*F02D 41/38* (2006.01)
*F02D 41/30* (2006.01)
(Continued)

(52) U.S. Cl.
CPC ..... *F02D 41/3863* (2013.01); *F02D 41/3076* (2013.01); *F02D 41/3082* (2013.01);
(Continued)

(58) Field of Classification Search
CPC ..... F02D 41/3863; F02D 41/3076; F02D 41/3082; F02D 2001/007; F02D 2001/009; F02M 65/006
(Continued)

(56) References Cited

U.S. PATENT DOCUMENTS 6,216,674 B1 * 4/2001 Corkill ..... F02M 25/0809 123/520
2005/0235964 A1 * 10/2005 Shibata ..... F02D 41/2467 123/458
(Continued)

FOREIGN PATENT DOCUMENTS

DE 102006025966 A1 12/2007
DE 102008041537 A1 3/2010
(Continued)

OTHER PUBLICATIONS

International Search Report for International Patent Application No. PCT/SE2017/050659 dated Jun. 29, 2017.
(Continued)

*Primary Examiner* — Mahmoud Gimie
(74) *Attorney, Agent, or Firm* — Moore & Van Allen PLLC; W. Kevin Ransome

(57) ABSTRACT

Provided is a method for diagnosing unintended fuelling from one or more fuel injectors of a multi cylinder internal combustion engine during engine operation. Pressurized fuel is intended to be distributed by means of said fuel injectors from said accumulator tank to the cylinders for combustion. An oxidation catalyst is arranged downstream said cylinders. The method comprises: determining the pressure in the fuel accumulator tank and whether said pressure is decreasing; and determining whether the actual amount of fuel provided by the pump unit exceeds the demanded amount of fuel. The method further comprises the steps of: determining whether the temperature associated with the oxidation cata-
(Continued)

lyst is above a certain level and/or determining whether the air/fuel ratio is below a certain level and/or determining whether an amount of particulate matter is above a certain level; and confirming an unintended fuelling based on the determined conditions.

20 Claims, 3 Drawing Sheets

(51) Int. Cl.
*F02M 65/00* (2006.01)
*F02D 1/00* (2006.01)

(52) U.S. Cl.
CPC ..... *F02M 65/006* (2013.01); *F02D 2001/007* (2013.01); *F02D 2001/009* (2013.01)

(58) Field of Classification Search
USPC ..... 123/456
See application file for complete search history.

(56) References Cited

U.S. PATENT DOCUMENTS

2006/0054149 A1 3/2006 Uchiyama
2011/0113756 A1 5/2011 Yezerets et al.
2011/0191005 A1 8/2011 Iwazaki et al.
2012/0123703 A1* 5/2012 Serra ..... F02D 41/2432 702/47
2013/0013175 A1 1/2013 Nistler et al.
2015/0020777 A1* 1/2015 Carey ..... F02D 41/22 123/445

FOREIGN PATENT DOCUMENTS

EP 0860600 A2 8/1998
EP 2246550 A1 11/2010
EP 2927466 A1 10/2015
KR 101518946 B1 * 5/2015 ..... F02D 41/3809

OTHER PUBLICATIONS

Written Opinion of the International Searching Authority for International Patent Application No. PCT/SE2017/050659 dated Jun. 29, 2017.
SCANIA CV AB, International Application No. PCT/SE2017/050659, International Preliminary Report on Patentability, dated Jan. 15, 2019.

* cited by examiner

METHOD AND SYSTEM FOR DIAGNOSING UNINTENDED FUELLING FROM FUEL INJECTORS OF AN ENGINE

CROSS-REFERENCE TO RELATED APPLICATIONS

This application is a national stage application (filed under 35 § U.S.C. 371) of PCT/SE2017/050659, filed Jun. 19, 2017 of the same title, which, in turn, claims priority to Swedish Application No. 1651041-4 filed Jul. 12, 2016; the contents of each of which are hereby incorporated by reference.

FIELD OF THE INVENTION

The invention relates to systems, methods and computer program products for diagnosing unintended fuelling from one or more fuel injectors of a multi cylinder internal combustion engine during engine operation.

BACKGROUND OF THE INVENTION

Vehicles such as heavy vehicles comprising trucks having a multi cylinder internal combustion engine comprises a fuel injection system in which a pump unit provides pressurized fuel to a fuel accumulator tank based on a fuel demand. Pressurized fuel is distributed by means of fuel injectors from said accumulator tank to the cylinders for combustion. A problem that may occur is that one or more fuel injectors injects fuel unintentionally, so called unintended fuelling. Such unintended fuelling may cause serious engine damage and also after treatment damage.

A known way of diagnosing unintended fuelling is to detect pressure and possible pressure decrease in the fuel accumulator tank and determining whether the actual amount of fuel provided by the pump unit exceeds the demanded amount of fuel. If it is determined that the pressure in the accumulator tank is decreasing and/or the actual amount of fuel provided by the pump unit exceeds the demanded amount of fuel this may be caused by unintended fuelling. However, it may also be due to fuel leakage resulting in fuel not reaching the cylinders which in turn results in the pump unit providing a higher amount of fuel than the demanded amount of fuel.

US2013013175 and EP2246550 discloses detection of fuel leakage in a fuel injection system by using low pressure in the fuel accumulator tank as indicator.

There is however a need for improving accuracy in diagnosing of fuel so as to more accurately be able to diagnose unintended fuelling.

SUMMARY OF THE INVENTION

An object of the present invention is to provide a method for diagnosing unintended fuelling from one or more fuel injectors of a multi cylinder internal combustion engine during engine operation which improves the accuracy in diagnosing unintended fuelling.

Another object of the present invention is to provide a system for diagnosing unintended fuelling from one or more fuel injectors of a multi cylinder internal combustion engine during engine operation which improves the accuracy in diagnosing unintended fuelling.

These and other objects, apparent from the following description, are achieved by a method, a system, a vehicle, a computer program and a computer program product, as set out in the appended independent claims. Preferred embodiments of the method and the system are defined in appended dependent claims.

Specifically an object of the invention is achieved by a method for diagnosing unintended fuelling from one or more fuel injectors of a multi cylinder internal combustion engine during engine operation. A pump unit is arranged to provide pressurized fuel to a fuel accumulator tank based on a fuel demand. Pressurized fuel is intended to be distributed by means of said fuel injectors from said accumulator tank to the cylinders for combustion. An oxidation catalyst is arranged downstream said cylinders. The method comprises the steps of: determining the pressure in the fuel accumulator tank and whether said pressure is decreasing; and determining whether the actual amount of fuel provided by the pump unit exceeds the demanded amount of fuel. The method further comprises the steps of: determining whether the temperature associated with the oxidation catalyst is above a certain level and/or determining whether the air/fuel ratio is below a certain level and/or determining whether an amount of particulate matter is above a certain level; and confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

Hereby the accuracy in diagnosing unintended fuelling is increased in that other reasons such as fuel leakage may be excluded.

It is sufficient with only one of the steps of determining whether the temperature associated with the oxidation catalyst is above a certain level, determining whether the air/fuel ratio is below a certain level and determining whether an amount of particulate matter is above a certain level together with the steps of determining the pressure in the fuel accumulator tank and whether said pressure is decreasing, and determining whether the actual amount of fuel provided by the pump unit exceeds the demanded amount of fuel in order to be able to diagnose unintended fuelling to a high accuracy. By having two of said steps of temperature associated with the oxidation catalyst is above a certain level, determining whether the air/fuel ratio is below a certain level and determining whether an amount of particulate matter is above a certain level the accuracy is further increased and having all three steps the accuracy is further increased. For example a malfunction of a sensor for detecting any of these steps of determining temperature, air/fuel ratio and particulate matter may cause an error in the diagnose, which risk is reduced with two or all three of these steps.

The step of determining whether the temperature associated with the oxidation catalyst is above a certain level may comprise utilizing any suitable temperature sensor.

The step of determining whether the air/fuel ratio is below a certain level may comprise utilizing any suitable lambda sensor.

The step of determining whether an amount of particulate matter is above a certain level may comprise utilizing any suitable particulate matter sensor.

Pressurized air is also distributed to the cylinders for said combustion. According to an embodiment ambient air is taken in via an air intake, filtered, pressurized by means a compressor, and passes an intercooler, prior to being distributed to the cylinders.

According to an embodiment the method comprises the step of excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level. Hereby the accuracy in excluding unintended fuelling is increased.

According to an embodiment the method comprises the step of taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

According to an embodiment the method comprises the step of excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level. Hereby the accuracy in excluding unintended fuelling is increased.

According to an embodiment the method comprises the step of excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level. Hereby the accuracy in excluding unintended fuelling is increased.

Specifically an object of the invention is achieved by a system for diagnosing unintended fuelling from one or more fuel injectors of a multi cylinder internal combustion engine during engine operation. A pump unit is arranged to provide pressurized fuel to a fuel accumulator tank based on a fuel demand. Pressurized fuel is intended to be distributed by means of said fuel injectors from said accumulator tank to the cylinders for combustion. An oxidation catalyst is arranged downstream said cylinders. The system comprises means for determining the pressure the pressure in the fuel accumulator tank and whether said pressure is decreasing; and means for determining whether the actual amount of fuel provided by the pump unit exceeds the demanded amount of fuel. The system further comprises means for determining whether the temperature associated with the oxidation catalyst is above a certain level and/or means for determining whether the air/fuel ratio is below a certain level and/or means for determining whether an amount of particulate matter is above a certain level; and means for confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

According to an embodiment the system comprises means for excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level.

According to an embodiment the system comprises means for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

According to an embodiment the system comprises means for excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level.

According to an embodiment the system comprises means for excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

The system for diagnosing unintended fuelling from one or more fuel injectors of a multi cylinder internal combustion engine during engine operation is adapted to perform the methods as set out herein.

The system according to the invention has the advantages according to the corresponding method set out herein.

Specifically an object of the invention is achieved by a vehicle comprising a system according to the invention as set out herein.

Specifically an object of the invention is achieved by a computer program for diagnosing unintended fuelling from one or more fuel injectors of a multi cylinder internal combustion engine during engine operation, said computer program comprising program code which, when run on an electronic control unit or another computer connected to the electronic control unit, causes the electronic control unit to perform the method according to the invention.

Specifically an object of the invention is achieved by a computer program product comprising a digital storage medium storing the computer program.

BRIEF DESCRIPTION OF THE DRAWINGS

For a better understanding of the present invention reference is made to the following detailed description when read in conjunction with the accompanying drawings, wherein like reference characters refer to like parts throughout the several views, and in which.

DETAILED DESCRIPTION OF THE INVENTION

Hereinafter the term "link" refers to a communication link which may be a physical connector, such as an optoelectronic communication wire, or a non-physical connector such as a wireless connection, for example a radio or microwave link.

Hereinafter the term "unintended fuelling" refers to fuel being injected/sprayed/transferred from one or more fuel injectors when fuel is not intended to be injected by means of said one or more injectors or not that high amount of fuel is intended to be injected by said one or more fuel injectors.

Hereinafter the term "fuel leakage" refers to general leakage of fuel not reaching said cylinders.

The term "certain level" e.g. with regard to determining whether the temperature associated with the oxidation catalyst is above a certain level; determining whether the air/fuel ratio is below a certain level; determining whether an amount of particulate matter is above a certain level, may according to an embodiment refer to "predetermined level".

Hereinafter the term "means for" e.g. in relation to "means for determining the pressure and whether said pressure is decreasing", "means for determining whether the actual amount of fuel provided by the pump unit exceeds the demanded amount of fuel", "means for determining whether the temperature associated with the oxidation catalyst is above a certain level", "means for determining whether the air/fuel ratio is below a certain level", "means for determining whether an amount of particulate matter is above a certain level"; and "means for confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level" refers to "means adapted for".

Below in connection to FIG. 2 an embodiment for a 6-cylinder engine is described.

The engine according to the present invention could be any suitable internal combustion engine with any suitable number of cylinders with any suitable number of injections and any suitable number of pump strokes per crankshaft revolution. The internal combustion engine according to the present invention could for example be a 5-cylinder engine, a 6-cylinder engine or an 8-cylinder engine. The cylinders could be in any suitable alignment, for example inline engine or a V-engine.

The invention is thus applicable to any multi cylinder internal combustion engine with any known number of cylinders/injectors.

The invention is applicable to two stroke engines, four stroke engines, six stroke engines and eight stroke engines.

Figure 1:
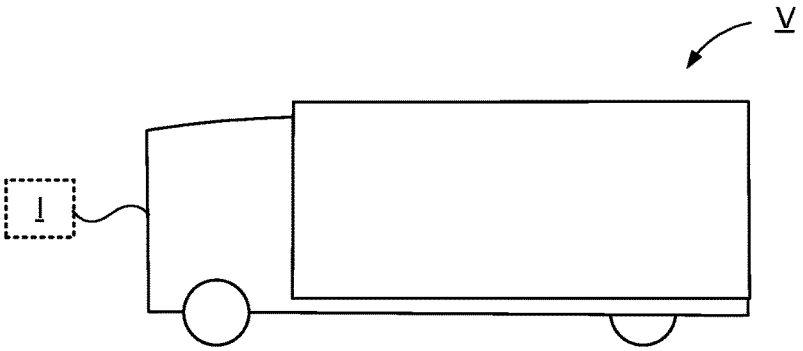
FIG. 1 schematically illustrates a side view of a vehicle according to an embodiment of the present invention.

FIG. 1 schematically illustrates a side view of a vehicle V according to the present invention. The exemplified vehicle V is a heavy vehicle in the shape of a truck. The vehicle according to the present invention could be any suitable vehicle such as a bus or a car.

The vehicle 1 comprises a system I for diagnosing unintended fuelling from one or more fuel injectors of a multi cylinder internal combustion engine during engine operation according to an embodiment of the present invention.

Figure 2:
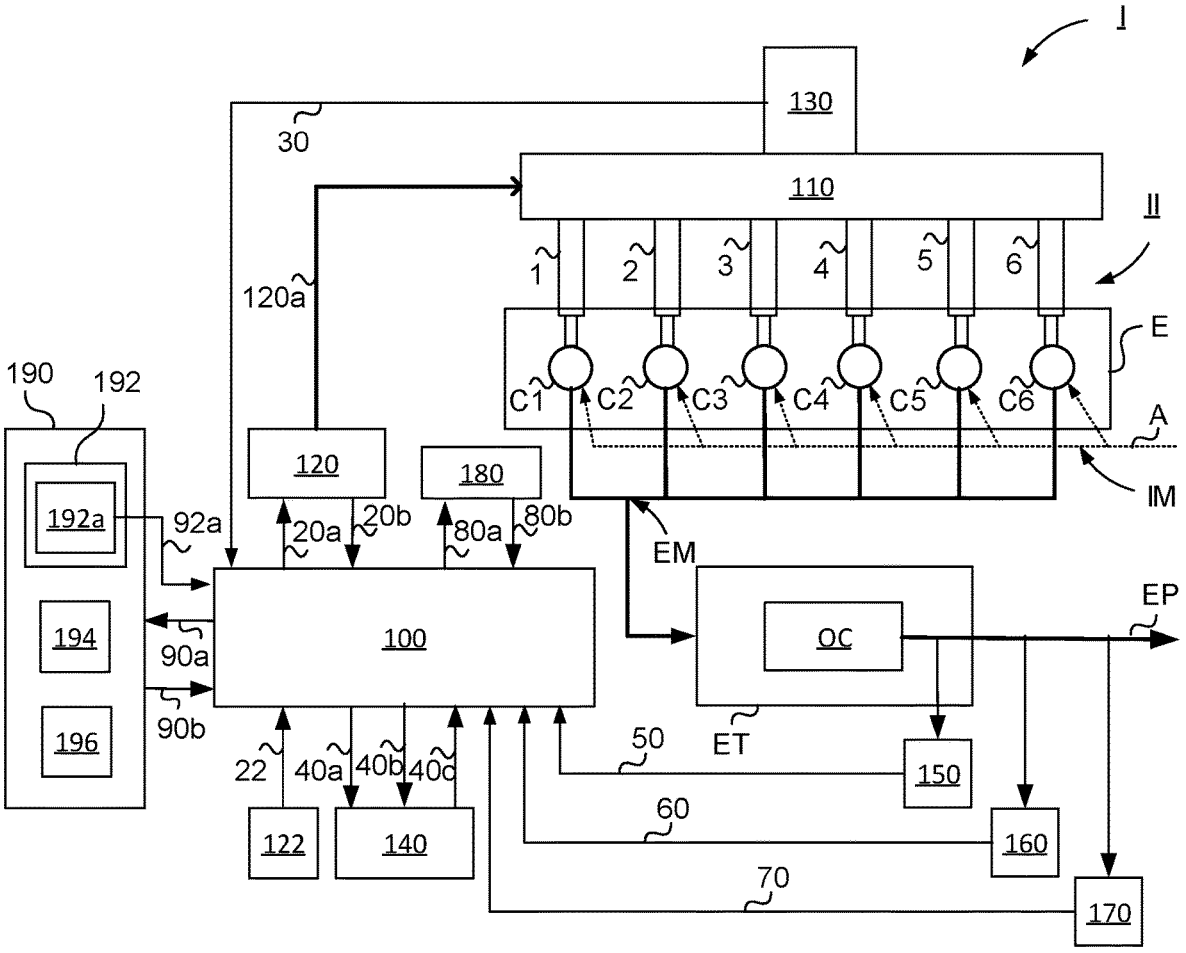
FIG. 2 schematically illustrates a system for diagnosing unintended fuelling from one or more fuel injectors of a multi cylinder internal combustion engine during engine operation according to an embodiment of the present invention.

FIG. 2 schematically illustrates a system I for diagnosing unintended fuelling from one or more fuel injectors 1, 2, 3, 4, 5, 6 of a multi cylinder C1, C2, C3, C4, C5, C6 internal combustion engine E during engine operation according to an embodiment of the present invention.

The system I is comprised in a fuel injection system II which may be used in any vehicle comprising any ground vehicle such as a truck or lorry. The system I could according to an embodiment constitute the system II.

The system I is applicable to any suitable internal combustion engine with any suitable number of cylinders.

The system I is intended to perform a method according to the present invention.

A pump unit 120 is arranged to provide pressurized fuel to a fuel accumulator tank 110 based on a fuel demand.

The thus pressurized fuel is intended to be distributed from said accumulator tank 110 to the cylinders by means of fuel injectors 1, 2, 3, 4, 5, 6 so as to rotate a crankshaft of the engine E.

The multi cylinder internal combustion engine E is according to an embodiment a diesel engine. The internal combustion engine E according to this embodiment is a six cylinder engine with six fuel injectors 1-6, one for each cylinder. The fuel injectors 1-6 are according to an embodiment electronic fuel injectors.

The fuel injection system II comprises the accumulator tank 110 arranged to receive pressurized fuel from the pump unit 120. The fuel injection system II comprises the electronic control unit 100. The fuel injection system II comprises the fuel injectors 1-6. The pump unit 120 is arranged to pump fuel from a fuel tank, not shown.

The system I comprises an electronic control unit 100. The electronic control unit 100 is arranged to control the fuel injection in the fuel injection system II.

The pump unit 120 is a high pressure pump unit 120 being adapted to pressurize the fuel so that it enters at high pressure in the accumulator tank 110 which takes the form of a so-called Common Rail. The high fuel pressure in the accumulator tank 110 constitutes a power source making it possible for fuel to be injected at high pressure into the respective cylinders of the engine E. The fuel in the accumulator tank 110 is intended to be distributed to all the cylinders C1-C6 of the engine E via the fuel injectors 1-6.

The system I comprises according to an embodiment means 122 adapted for demanding an amount of fuel. The means for demanding a fuel may comprise a gas pedal or the like. The fuel demand is according to an embodiment a fuel demand from an operator of the vehicle, which according to an embodiment may comprise the operator/driver activating the gas pedal which corresponds to a demanded amount of fuel.

The means 122 for demanding an amount of fuel is according to an embodiment operably connected to the electronic control unit 100 via a link. The electronic control unit 100 is via the link arranged to receive a signal representing data for demanded amount of fuel.

The pump unit 120 is operably connected to the electronic control unit 100 via a link 20*a*. The electronic control unit is via the link 20*a* arranged to send a signal to the pump unit 120 representing data for demanded amount of fuel.

The pump unit 120 is operably connected to the electronic control unit 100 via a link 20*b*. The electronic control unit is via the link 20*b* arranged to receive a signal from the pump unit 120 representing data for actual amount of fuel provided to the accumulator tank 110.

The electronic control unit 100 is thus arranged to control the operation of the pump unit 120. The electronic control unit 100 is arranged to send signals to the pump unit 120 representing data for controlling provision of pressurized fuel to the accumulator tank 110. The pressurized fuel is provided to the fuel accumulator tank 110 via a fuel pipe 120*a*.

The system I comprises means 130 for determining the pressure in the fuel accumulator tank 110 and whether said pressure is decreasing. The means 130 for determining the pressure in the fuel accumulator tank 110 and whether said pressure is decreasing comprises one or more sensor units configured to detect the pressure in the fuel accumulator tank 110, e.g. a common rail. The means 130 for determining the pressure in the fuel accumulator tank 110 and whether said pressure is decreasing comprises according to an embodiment a rail pressure sensor arranged to perform pressure sampling by means of repeatedly detecting the pressure in the tank 110 so as to obtain a set of pressure samples. The means 130 for determining the pressure accumulator tank 110 is arranged to continuously or intermittently determining the pressure in order to determine whether said pressure is decreasing.

The electronic control unit 100 is arranged to control the operation of the fuel injectors 1-6. The electronic control unit 100 is operably connected to the fuel injectors 1-6 via links. The electronic control unit 100 is via the links arranged to send signals to the injectors representing data for controlling the respective injector 1-6 comprising data for controlling the on-time of the respective injector.

The electronic control unit 100 is according to an embodiment via links arranged to send electrical signals representing data for opening injector to the respective injector.

The electronic control unit 100 is according to an embodiment via links arranged to send electrical signals representing data for closing injector to the respective injector.

The electronic control unit 100 is operably connected to the means 130 for determining the pressure in the fuel accumulator tank 110 via a link 30. The electronic control unit 100 is via the link 30 arranged to receive signals from the means 130 representing pressure data for determined pressure in the accumulator tank 110 and where applicable data for decrease of pressure in the accumulator tank 110.

The electronic control unit 100 is arranged to control the operation of the fuel injectors 1-6 based on the thus determined pressure in the accumulator tank 110. The electronic control unit 100 is operably connected to the fuel injectors 1-6 via links, not shown.

The system I comprises means 140 for determining whether the actual amount of fuel provided by the pump unit 120 exceeds the demanded amount of fuel. The means 140 is according to an embodiment comprised in the electronic control unit 100.

The electronic control unit 100 is operably connected to the means 140 for determining whether the actual amount of fuel provided by the pump unit 120 exceeds the demanded amount of fuel via a link 40*a*. The electronic control unit 100 is via said link 40*a* arranged to send a signal to the means 140 representing data for demanded amount of fuel.

The electronic control unit 100 is operably connected to the means 140 for determining whether the actual amount of fuel provided by the pump unit exceeds the demanded amount of fuel via a link 40*b*. The electronic control unit 100 is via said link 40*b* arranged to send a signal to the means 140 representing data for actual amount of fuel provided by the pump unit 120.

The means 140 for determining whether the actual amount of fuel provided by the pump unit 120 exceeds the demanded amount of fuel is arranged to compare the thus received data representing actual amount and demanded amount so as to determine whether the actual amount of fuel provided by the pump unit 120 exceeds the demanded amount of fuel.

The electronic control unit 100 is operably connected to the means 140 for determining whether the actual amount of fuel provided by the pump unit exceeds the demanded amount of fuel via a link 40*c*. The electronic control unit 100 is via said link 40*b* arranged to receive a signal from the means 140 representing data for whether the actual amount of fuel provided by the pump unit 120 exceeds the demanded amount of fuel.

The means 140 for determining whether the actual amount of fuel provided by the pump unit exceeds the demanded amount of fuel comprising according to an embodiment means for determining a relationship between the demanded amount of fuel and the actual amount of fuel provided by the pump unit. The demanded amount of fuel and the actual amount of fuel provided by the pump unit may be expressed as a flow. The demanded amount of fuel is according to an embodiment represented by a control signal and the actual amount of fuel provided by the pump unit is according to an embodiment represented by an actual signal of the pump unit. The pump unit 120 is according to an embodiment an electrical pump unit.

Pressurized air A is distributed to the cylinders C1-C6 via said intake manifold.

Ambient air is taken in via an air intake, filtered, pressurized by means a compressor, not shown, and passes an intercooler, not shown, prior to being distributed to the cylinders C1-C6 via said intake manifold IM.

Thus, pressurized fuel injected from the fuel injectors 1-6 is provided to the cylinders C1-C6 and pressurized air is also provided to the cylinders C1-C6 for combustion thus providing exhaust gas.

Exhaust gas is distributed from the cylinders C1-C6 via an exhaust gas manifold EM to an exhaust treatment system ET arranged to treat the exhaust gas in order to reduce emissions so that treated exhaust gases exits an exhaust gas pipe EP. The exhaust gas distributed to the exhaust treatment system ET may comprise non-combusted fuel and particulate matter. The exhaust gas distributed to the exhaust treatment system ET may comprise particulate matter such a soot particles. The exhaust gas distributed to the exhaust treatment system ET will have a certain air/fuel ratio, i.e. a certain lambda-value.

Prior to reaching the exhaust treatment system ET the exhaust gas is according to an embodiment arranged to pass a turbine, not shown, for operating a turbocharger, not shown, such that said compressor compresses the filtered air.

The exhaust treatment system ET comprises an oxidation catalyst OC for exhaust gas emission control. According to an embodiment said oxidation catalyst OC is a so called Diesel Oxidation Catalyst (DOC), which is configured to oxidize the hydrocarbons and carbon monoxide with oxygen to form carbon oxide and water. If a certain temperature is exceeded, e.g. a temperature in the range of about 350 degrees or a temperature in the range of 250 degrees, a thermal oxidation occurs.

The system I comprises according to an embodiment means 150 for determining whether the temperature associated with the oxidation catalyst is above a certain level. The means 150 for determining whether the temperature associated with the oxidation catalyst is above a certain level comprises one or more temperature sensors. The means 150 comprising e.g. said one or more temperature sensors is arranged downstream of the oxidation catalyst OC.

The system I comprises according to an embodiment means 160 for determining whether the air/fuel ratio is below a certain level. The means 160 for determining whether the air/fuel ratio is below a certain level may comprise any suitable sensor comprising any suitable lambda-sensor.

The system I further comprises according to an embodiment means 170 for determining whether an amount of particulate matter is above a certain level. The means 170 for determining whether an amount of particulate matter is above a certain level comprises any suitable sensor for detecting the amount of particulate matter. Such as sensor is according to a variant called a PM-sensor.

The system I comprises means 180 for confirming an unintended fuelling if the pressure in the accumulator tank 110 is decreasing and/or the amount of fuel provided by the pump unit 120 exceeds the demanded amount of fuel by a certain amount, and said temperature is above said certain level and/or said air/fuel ratio is below said certain level and/or said particulate matter is above said certain level.

It is sufficient with only one of the means 150 for determining whether the temperature associated with the oxidation catalyst is above a certain level, means 160 for determining whether the air/fuel ratio is below a certain level and means 170 for determining whether an amount of particulate matter is above a certain level together with the means 130 for determining the pressure in the fuel accumulator tank and whether said pressure is decreasing, and means 140 for determining whether the actual amount of fuel provided by the pump unit exceeds the demanded amount of fuel in order to be able to diagnose unintended fuelling to a high accuracy. By having two of said means 150 for determining temperature associated with the oxidation catalyst is above a certain level, means 160 for determining whether the air/fuel ratio is below a certain level and determining and means 170 for determining whether an amount of particulate matter is above a certain level the accuracy is further increased and having all three means 150, 160, 170 the accuracy is further increased.

The electronic control unit 100 is operably connected to the means 150 for determining whether the temperature associated with the oxidation catalyst is above a certain level via a link 50. The electronic control unit 100 is via said link 50 arranged to receive a signal from said means 150 representing data for whether the temperature associated with the oxidation catalyst is above a certain level.

The electronic control unit 100 is operably connected to the means 160 for determining whether the air/fuel ratio is below a certain level via a link 60. The electronic control unit 100 is via said link 60 arranged to receive a signal from said means 160 representing data for whether the air/fuel ratio is below a certain level.

The electronic control unit 100 is operably connected to the means 170 for determining whether an amount of particulate matter is above a certain level via a link 70. The electronic control unit 100 is via said link 70 arranged to receive a signal from said means 170 representing data for whether an amount of particulate matter is above a certain level.

The electronic control unit 100 is operably connected to the means 180 for confirming an unintended fuelling if the pressure in the accumulator tank 110 is decreasing and/or the amount of fuel provided by the pump unit 120 exceeds the demanded amount of fuel by a certain amount, and said temperature is above said certain level and/or said air/fuel ratio is below said certain level and/or said particulate matter is above said certain level via a link 80*a*. The electronic control unit 100 is via said link 80*a* arranged to send signals to said means 180 representing data for pressure in the accumulator tank is decreasing and/or data for amount of fuel provided by the pump unit exceeding the demanded amount of fuel by a certain amount, and data for said temperature being above said certain level and/or data for said air/fuel ratio being below said certain level and/or data for said particulate matter being above said certain level.

The electronic control unit 100 is operably connected to the means 180 for confirming an unintended fuelling if the pressure in the accumulator tank 110 is decreasing and/or the amount of fuel provided by the pump unit 120 exceeds the demanded amount of fuel by a certain amount, and said temperature is above said certain level and/or said air/fuel ratio is below said certain level and/or said particulate matter is above said certain level via a link 80*b*. The electronic control unit 100 is via said link 80*b* arranged to receive a signal from said means 180 representing data for confirmed unintended fuelling. A signal from said means 180 and/or from the electronic control unit 100 representing data for confirmed unintended fuelling may be sent to any unit for providing information about said confirmed diagnose such as any suitable presentation unit comprising a display unit for displaying the information and/or a sound unit for providing audible information and/or any suitable internal/external storage means and/or any suitable server unit and/or the like.

According to an embodiment the system I comprises means 190 for excluding presence of unintended fuelling. The means 190 for excluding presence of unintended fuelling may comprise any suitable unit for processing data comprising any suitable calculation unit and/or any suitable electronic control unit and/or any suitable server unit or the like.

The means 190 for excluding presence of unintended fuelling comprises means 192 for excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level.

According to an embodiment the system comprises means 192*a* for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage. Thus the means 192 comprises said means 192*a*.

The means 190 for excluding presence of unintended fuelling comprises means 194 for excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level.

The means 190 for excluding presence of unintended fuelling comprises means 196 for excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

The electronic control unit 100 is operably connected to the means 190 for excluding presence of unintended fuelling via a link 90*a*.

The electronic control unit 100 is via said link 90*a* arranged to send a signal to said means 190 representing data for accumulator tank is decreasing and/or data for the amount of fuel provided by the pump unit exceeding the demanded amount of fuel by a certain amount, and data for said temperature being below said certain level and data for said air/fuel ratio being above said certain level and said particulate matter is below said certain level.

The electronic control unit 100 is via said link 90*a* arranged to send a signal to said means 190 representing data for the pressure in the accumulator tank being at a predetermined level and data for the amount of fuel provided by the pump unit not exceeding the demanded amount of fuel by said certain amount, and data for said temperature being above said certain level and/or data for said air/fuel ratio being below said certain level and/or data for said particulate matter being above said certain level.

The electronic control unit 100 is via said link 90*a* arranged to send a signal to said means 190 representing data for the pressure in the accumulator tank is at a predetermined level and data for the amount of fuel provided by the pump unit not exceeding the demanded amount of fuel by said certain amount, and data for said temperature being above said certain level and/or data for said air/fuel ratio being below said certain level and/or data for said particulate matter being above said certain level.

The electronic control unit 100 is operably connected to the means 190 for excluding presence of unintended fuelling via a link 90*b*. The electronic control unit 100 is via said link 90*b* arranged to receive a signal from said means 190 representing data for excluding presence of unintended fuelling.

A signal from said means 190 and/or from the electronic control unit 100 representing data for excluding presence of unintended fuelling may be sent to any unit for providing information about exclusion of unintended fuelling such as any suitable presentation unit comprising a display unit for displaying the information and/or a sound unit for providing audible information and/or any suitable internal/external storage means and/or any suitable server unit and/or the like.

The electronic control unit 100 is operably connected to the means 192*a* for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage via a link 92*a*. The electronic control unit 100 is via said link 92*a* arranged to receive a signal from said means 192*a* representing data for indicated fuel leakage.

A signal from said means 192*a* and/or from the electronic control unit 100 representing data for indicated fuel leakage may be sent to any unit for providing information about diagnosed fuel leakage such as any suitable presentation unit comprising a display unit for displaying the information and/or a sound unit for providing audible information and/or any suitable internal/external storage means and/or any suitable server unit and/or the like.

Figure 3:
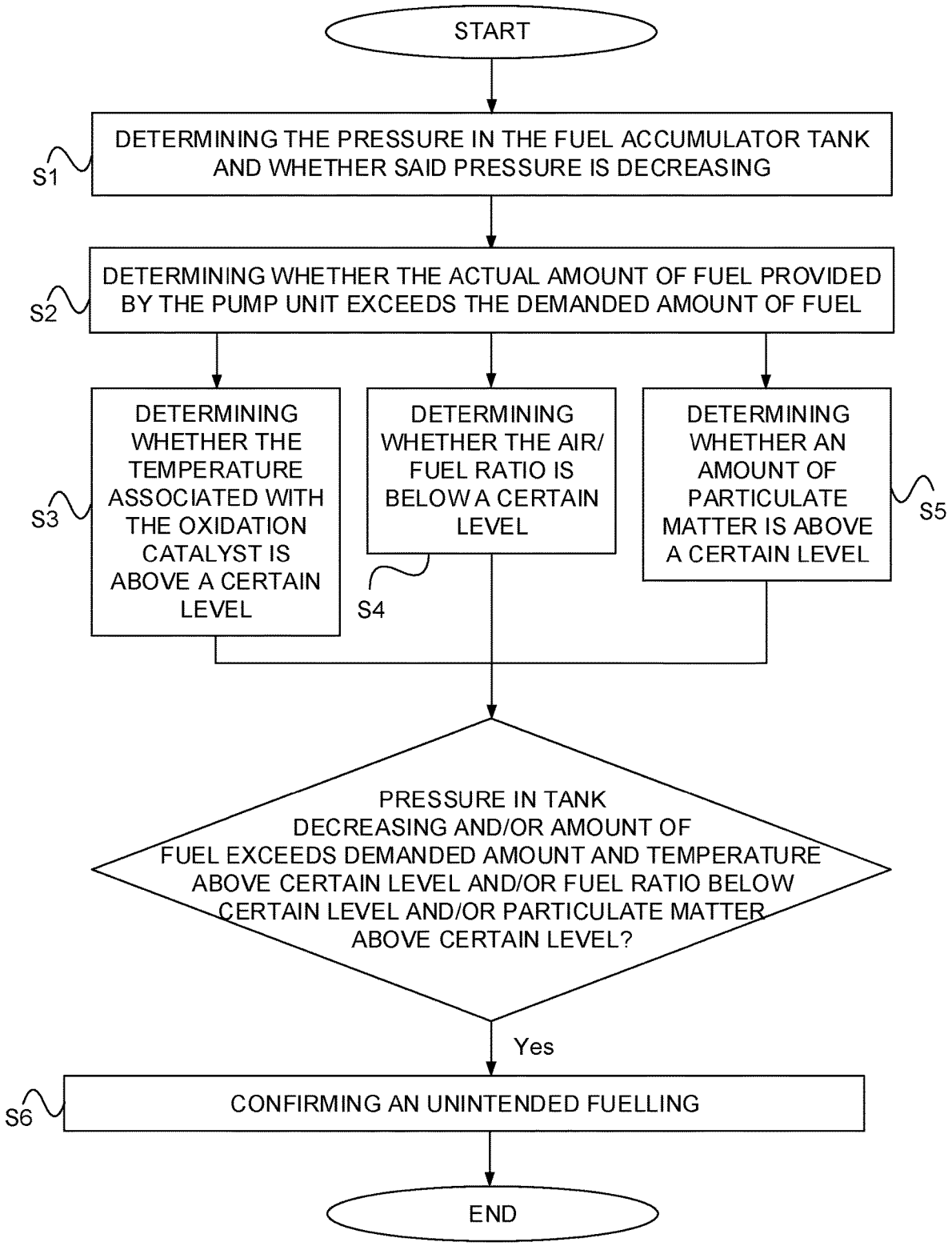
FIG. 3 schematically illustrates a method for diagnosing unintended fuelling from one or more fuel injectors of a multi cylinder internal combustion engine during engine operation according to an embodiment of the present invention.

FIG. 3 schematically illustrates a method for diagnosing unintended fuelling from one or more fuel injectors of a multi cylinder internal combustion engine during engine operation according to an embodiment of the present invention.

According to the embodiment the method for diagnosing unintended fuelling from one or more fuel injectors of a multi cylinder internal combustion engine during engine operation comprises a step S1. In this step the pressure in the fuel accumulator tank and whether said pressure is decreasing is determined.

According to the embodiment the method for diagnosing unintended fuelling from one or more fuel injectors of a multi cylinder internal combustion engine during engine operation comprises a step S2. In this step it is determined whether the actual amount of fuel provided by the pump unit exceeds the demanded amount of fuel.

According to the embodiment the method for diagnosing unintended fuelling from one or more fuel injectors of a multi cylinder internal combustion engine during engine operation comprises a step S3. In this step it is determined whether the temperature associated with the oxidation catalyst is above a certain level.

According to the embodiment the method for diagnosing unintended fuelling from one or more fuel injectors of a multi cylinder internal combustion engine during engine operation comprises a step S4. In this step it is determined whether the air/fuel ratio is below a certain level.

According to the embodiment the method for diagnosing unintended fuelling from one or more fuel injectors of a multi cylinder internal combustion engine during engine operation comprises a step S5. In this step it is determined whether an amount of particulate matter is above a certain level.

According to the embodiment the method for diagnosing unintended fuelling from one or more fuel injectors of a multi cylinder internal combustion engine during engine operation comprises a step S6. In this step an unintended fuelling is determined if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

It is sufficient with only one of the steps of determining whether the temperature associated with the oxidation catalyst is above a certain level, determining whether the air/fuel ratio is below a certain level and determining whether an amount of particulate matter is above a certain level together with the steps of determining the pressure in the fuel accumulator tank and whether said pressure is decreasing, and determining whether the actual amount of fuel provided by the pump unit exceeds the demanded amount of fuel in order to be able to diagnose unintended fuelling to a high accuracy. By having two of said steps of temperature associated with the oxidation catalyst is above a certain level, determining whether the air/fuel ratio is below a certain level and determining whether an amount of particulate matter is above a certain level the accuracy is further increased and having all three steps the accuracy is further increased. For example a malfunction of a sensor for detecting any of these steps of determining temperature, air/fuel ratio and particulate matter may cause an error in the diagnose, which risk is reduced with two or all three of these steps.

The step of determining whether the temperature associated with the oxidation catalyst is above a certain level may comprise utilizing any suitable temperature sensor.

The step of determining whether the air/fuel ratio is below a certain level may comprise utilizing any suitable lambda sensor.

The step of determining whether an amount of particulate matter is above a certain level may comprise utilizing any suitable particulate matter sensor.

Pressurized air is also distributed to the cylinders for said combustion. According to an embodiment ambient air is taken in via an air intake, filtered, pressurized by means a compressor, and passes an intercooler, prior to being distributed to the cylinders.

According to an embodiment the method comprises the step of excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level. Hereby the accuracy in excluding unintended fuelling is increased.

According to an embodiment the method comprises the step of taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

According to an embodiment the method comprises the step of excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level. Hereby the accuracy in excluding unintended fuelling is increased.

According to an embodiment the method comprises the step of excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level. Hereby the accuracy in excluding unintended fuelling is increased.

The method and the method steps described above with reference to FIG. 3 are according to an embodiment performed with the system I according to FIG. 2.

Figure 4:
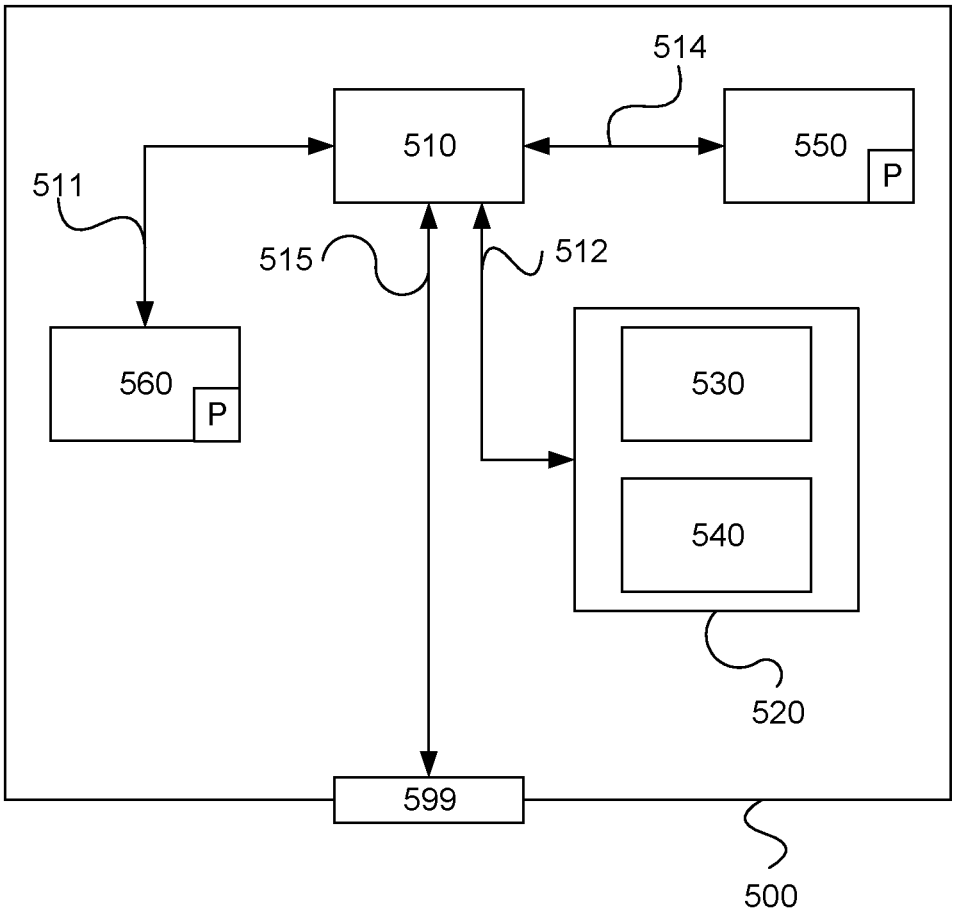
FIG. 4 schematically illustrates a computer according to an embodiment of the present invention.

With reference to FIG. 4, a diagram of an apparatus 500 is shown. The system I described with reference to FIG. 2 may according to an embodiment comprise apparatus 500. Apparatus 500 comprises a non-volatile memory 520, a data processing device 510 and a read/write memory 550. Non-volatile memory 520 has a first memory portion 530 wherein a computer program, such as an operating system, is stored for controlling the function of apparatus 500. Further, apparatus 500 comprises a bus controller, a serial communication port, I/O-means, an ND-converter, a time date entry and transmission unit, an event counter and an interrupt controller (not shown). Non-volatile memory 520 also has a second memory portion 540.

A computer program P is provided comprising routines for diagnosing unintended fuelling from one or more fuel injectors of a multi cylinder internal combustion engine during engine operation. A pump unit is arranged to provide pressurized fuel to a fuel accumulator tank based on a fuel demand. Pressurized fuel is intended to be distributed by means of said fuel injectors from said accumulator tank to the cylinders for combustion. An oxidation catalyst is arranged downstream said cylinders. The program P comprises routines for determining the pressure in the fuel accumulator tank and whether said pressure is decreasing. The program P comprises routines for determining whether the actual amount of fuel provided by the pump unit exceeds the demanded amount of fuel. The program P comprises routines for determining whether the temperature associated with the oxidation catalyst is above a certain level and/or determining whether the air/fuel ratio is below a certain level and/or determining whether an amount of particulate matter is above a certain level. The program P comprises routines for confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level. The program P comprises routines for excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level. The program P comprises routines for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage. The program P comprises routines for excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level. The program P comprises routines for excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level. The computer program P may be stored in an executable manner or in a compressed condition in a separate memory 560 and/or in read/write memory 550.

When it is stated that data processing device 510 performs a certain function it should be understood that data processing device 510 performs a certain part of the program which is stored in separate memory 560, or a certain part of the program which is stored in read/write memory 550.

Data processing device 510 may communicate with a data communications port 599 by means of a data bus 515. Non-volatile memory 520 is adapted for communication with data processing device 510 via a data bus 512. Separate memory 560 is adapted for communication with data processing device 510 via a data bus 511. Read/write memory 550 is adapted for communication with data processing device 510 via a data bus 514. To the data communications port 599 e.g. the links connected to the control units 100 may be connected.

When data is received on data port 599 it is temporarily stored in second memory portion 540. When the received input data has been temporarily stored, data processing device 510 is set up to perform execution of code in a manner described above. The signals received on data port 599 can be used by apparatus 500 for determining the pressure in the fuel accumulator tank based upon a pressure sampling in connection to at least one earlier fuel injection as a basis for controlling fuel injection to an individual cylinder. The signals received on data port 599 can be used by apparatus 500 for determining the pressure in the fuel accumulator tank and whether said pressure is decreasing. The signals received on data port 599 can be used by apparatus 500 for determining whether the actual amount of fuel provided by the pump unit exceeds the demanded amount of fuel. The signals received on data port 599 can be used by apparatus 500 for determining whether the temperature associated with the oxidation catalyst is above a certain level and/or determining whether the air/fuel ratio is below a certain level and/or determining whether an amount of particulate matter is above a certain level. The signals received on data port 599 can be used by apparatus 500 for confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level. The signals received on data port 599 can be used by apparatus 500 for excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level. The signals received on data port 599 can be used by apparatus 500 for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage. The signals received on data port 599 can be used by apparatus 500 for excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

Parts of the methods described herein can be performed by apparatus 500 by means of data processing device 510 running the program stored in separate memory 560 or read/write memory 550. When apparatus 500 runs the program, parts of the methods described herein are executed.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. A method for diagnosing unintended fuelling from one or more fuel injectors of a multi cylinder internal combustion engine during engine operation, a pump unit being arranged to provide pressurized fuel to a fuel accumulator tank based on a fuel demand, pressurized fuel being intended to be distributed by means of said fuel injectors from said accumulator tank to the cylinders for combustion, an oxidation catalyst being arranged downstream said cylinders, the method comprising the steps of:

determining a pressure in the fuel accumulator tank and whether said pressure is decreasing;

determining whether an actual amount of fuel provided by the pump unit exceeds a demanded amount of fuel;

determining whether a temperature associated with the oxidation catalyst is above a certain level and/or determining whether an air/fuel ratio is below a certain level and/or determining whether an amount of particulate matter is above a certain level; and confirming an unintended fuelling, if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

2. A method according to claim 1, further comprising the step of excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level.

3. A method according to claim 2, further comprising the step of taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

4. A method according to claim 1, further comprising the step of excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level.

5. A method according to claim 1, further comprising the step of excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

6. A system for diagnosing unintended fuelling from one or more fuel injectors of a multi cylinder internal combustion engine during engine operation, where a pump unit is arranged to provide pressurized fuel to a fuel accumulator tank based on a fuel demand, pressurized fuel being intended to be distributed by means of said fuel injectors from said accumulator tank to the cylinders for combustion, and an oxidation catalyst is arranged downstream said cylinders, the system comprising:

means for determining the pressure in the fuel accumulator tank and whether said pressure is decreasing;

means for determining whether the actual amount of fuel provided by the pump unit exceeds the demanded amount of fuel;

means for determining whether the temperature associated with the oxidation catalyst is above a certain level and/or means for determining whether the air/fuel ratio is below a certain level, and/or means for determining whether an amount of particulate matter is above a certain level; and means for confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

7. A system according to claim 6, further comprising means for excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level.

8. A system according to claim 7, further comprising means for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

9. A system according to claim 6, further comprising means for excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level.

10. A system according to claim 6, further comprising means for excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

11. A vehicle comprising a system for diagnosing unintended fuelling from one or more fuel injectors of a multi cylinder internal combustion engine during engine operation, where a pump unit is arranged to provide pressurized fuel to a fuel accumulator tank based on a fuel demand, pressurized fuel being intended to be distributed by means of said fuel injectors from said accumulator tank to the cylinders for combustion, and an oxidation catalyst is arranged downstream said cylinders, the system comprising:

means for determining the pressure in the fuel accumulator tank and whether said pressure is decreasing;

means for determining whether the actual amount of fuel provided by the pump unit exceeds the demanded amount of fuel; means for determining whether the temperature associated with the oxidation catalyst is above a certain level and/or means for determining whether the air/fuel ratio is below a certain level, and/or means for determining whether an amount of particulate matter is above a certain level; and means for confirming an unintended fuelling if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

12. A vehicle according to claim 11, wherein said system further comprises means for excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level.

13. A vehicle according to claim 12, wherein said system further comprising means for taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

14. A vehicle according to claim 11, wherein said system further comprising means for excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level.

15. A vehicle according to claim 11, wherein said system further comprising means for excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

16. A computer program product stored on a non-transitory computer-readable medium, said computer program product for diagnosing unintended fuelling from one or more fuel injectors of a multi cylinder internal combustion engine during engine operation, where a pump unit is arranged to provide pressurized fuel to a fuel accumulator tank based on a fuel demand, pressurized fuel being intended to be distributed by means of said fuel injectors from said accumulator tank to the cylinders for combustion, and an oxidation catalyst is arranged downstream said cylinders, said computer program product comprising computer instructions to cause one or more electronic control units or computers to perform the following operations:

determining a pressure in the fuel accumulator tank and whether said pressure is decreasing;

determining whether an actual amount of fuel provided by the pump unit exceeds a demanded amount of fuel;

determining whether a temperature associated with the oxidation catalyst is above a certain level and/or determining whether a air/fuel ratio is below a certain level and/or determining whether an amount of particulate matter is above a certain level; and confirming an unintended fuelling, if the pressure in the accumulator tank is decreasing and/or the amount of fuel provided by the pump unit exceeds the demanded amount of fuel by a certain amount, and said temperature is above said certain level and/or said air/fuel ratio is below said certain level and/or said particulate matter is above said certain level.

17. A computer program product according to claim 16, further comprising computer instructions to cause one or more electronic control units or computers to perform the operation of excluding presence of unintended fuelling if the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level.

18. A computer program product according to claim 17, further comprising computer instructions to cause one or more electronic control units or computers to perform the operation of taking the fact that the pressure in the accumulator tank is decreasing and/or the amount of fuel provided by the pump unit exceeds the demanded amount of fuel by a certain amount, and said temperature is below said certain level and said air/fuel ratio is above said certain level and said particulate matter is below said certain level as an indication of a fuel leakage.

19. A computer program product according to claim 16, further comprising computer instructions to cause one or more electronic control units or computers to perform the operation of excluding presence of unintended fuelling if the pressure in the accumulator tank is at a predetermined level and the amount of fuel provided by the pump unit does not exceed the demanded amount of fuel by said certain amount, and said temperature is above said certain level and/or said air/fuel ratio is below said certain level and/or said particulate matter is above said certain level.

20. A computer program product according to claim 16, further comprising computer instructions to cause one or more electronic control units or computers to perform the operation of excluding presence of unintended fuelling if the pressure in the accumulator tank is at a predetermined level and the amount of fuel provided by the pump unit does not exceed the demanded amount of fuel by said certain amount, and said temperature is below said certain level and said air/fuel ratio is above said certain level and said particulate matter is below said certain level.

* * * * *